US008344902B2

(12) United States Patent
Chen

(10) Patent No.: US 8,344,902 B2
(45) Date of Patent: Jan. 1, 2013

(54) CUP ASSEMBLY WITH CIRCUIT ACTUATING CAPABILITY

(75) Inventor: Jen-Lin Chen, Cupertino, CA (US)

(73) Assignee: Jen-Lin Chen, Cupertino, CA (US)

( * ) Notice: Subject to any disclaimer, the term of this patent is extended or adjusted under 35 U.S.C. 154(b) by 325 days.

(21) Appl. No.: 12/720,936

(22) Filed: Mar. 10, 2010

(65) Prior Publication Data

US 2010/0264045 A1 Oct. 21, 2010

(30) Foreign Application Priority Data

Apr. 16, 2009 (DE) ..... 20 2009 005 538 U

(51) Int. Cl.
*G08B 25/08* (2006.01)

(52) U.S. Cl. ..... 340/692; 340/384.73; 340/693.5

(58) Field of Classification Search ..... 340/692, 340/384.73, 693.5, 693.9
See application file for complete search history.

(56) References Cited

U.S. PATENT DOCUMENTS 5,990,790 A * 11/1999 Lusareta ..... 340/571
6,140,932 A * 10/2000 Frank et al. ..... 340/692
2006/0261233 A1* 11/2006 Williams et al. ..... 248/311.2

* cited by examiner

*Primary Examiner* — Hai Phan
*Assistant Examiner* — Ojiako Nwugo

(57) ABSTRACT

A cup assembly with circuit actuating capability comprises: a cup body having a bottom recess that is defined by a recess-defining wall and that has an open end, the recess-defining wall being provided with a threaded structure; a module support having a base part that covers the open end of the bottom recess, and a threaded confining part that is connected to the base part, that is received in the bottom recess, that defines an accommodating space, and that engages threadedly with the threaded structure; and a signal producing module mounted on the base part, received in the accommodating space, and including a signal producing member and a first switch that is coupled to the signal producing member and that is operable to enable and disable the signal producing member.

10 Claims, 8 Drawing Sheets

CUP ASSEMBLY WITH CIRCUIT ACTUATING CAPABILITY

CROSS-REFERENCE TO RELATED APPLICATION

This application claims priority of German Application No. 20 2009 005 538.8, filed on Apr. 16, 2009.

BACKGROUND OF THE INVENTION

1. Field of the Invention

This invention relates to a cup assembly with circuit actuating capability, more particularly to a cup assembly including a cup body and a module support embedded in a bottom of the cup body.

2. Description of the Related Art

U.S. Pat. No. 6,778,813 discloses a conventional cup assembly that includes a cup body having a bottom thread hole, and an audio system base part provided with a top thread member that engages threadedly with the bottom thread hole of the cup body. The audio system base part is disposed at an exterior of the cup body, and is preferably greater in diameter than the cup body to provide a more stable assembly.

SUMMARY OF THE INVENTION

The object of the present invention is to provide a cup assembly including a cup body and a module support with a signal producing module embedded in a bottom of the cup body.

According to the present invention, there is provided a cup assembly with circuit actuating capability. The cup assembly comprises: a cup body having a bottom recess that is defined by a recess-defining wall and that has an open end, the recess-defining wall being provided with a threaded structure; a module support having a base part that covers the open end of the bottom recess, and a threaded confining part that is connected to the base part, that is received in the bottom recess, that defines an accommodating space, and that engages threadedly with the threaded structure so as to permit the module support to be detachably secured to and embedded in the cup body; and a signal producing module mounted on the base part, received in the accommodating space, and including a signal producing member that is adapted to generate a signal upon actuation, and a first switch that is coupled to the signal producing member and that is operable to enable and disable the signal producing member.

BRIEF DESCRIPTION OF THE DRAWINGS

In drawings which illustrate embodiments of the invention.

DETAILED DESCRIPTION OF THE PREFERRED EMBODIMENT

Figure 1:
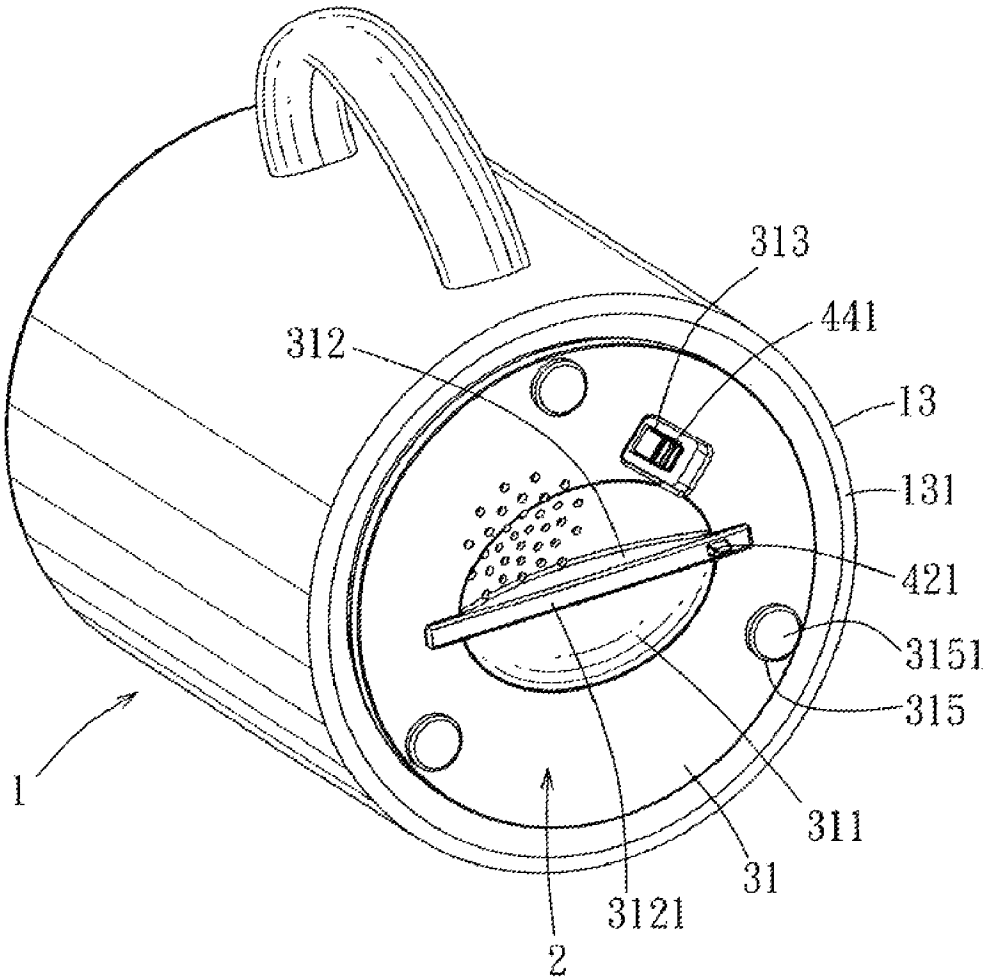
FIG. 1 is an assembled perspective view of the preferred embodiment of a cup assembly according to this invention.
Figure 2:
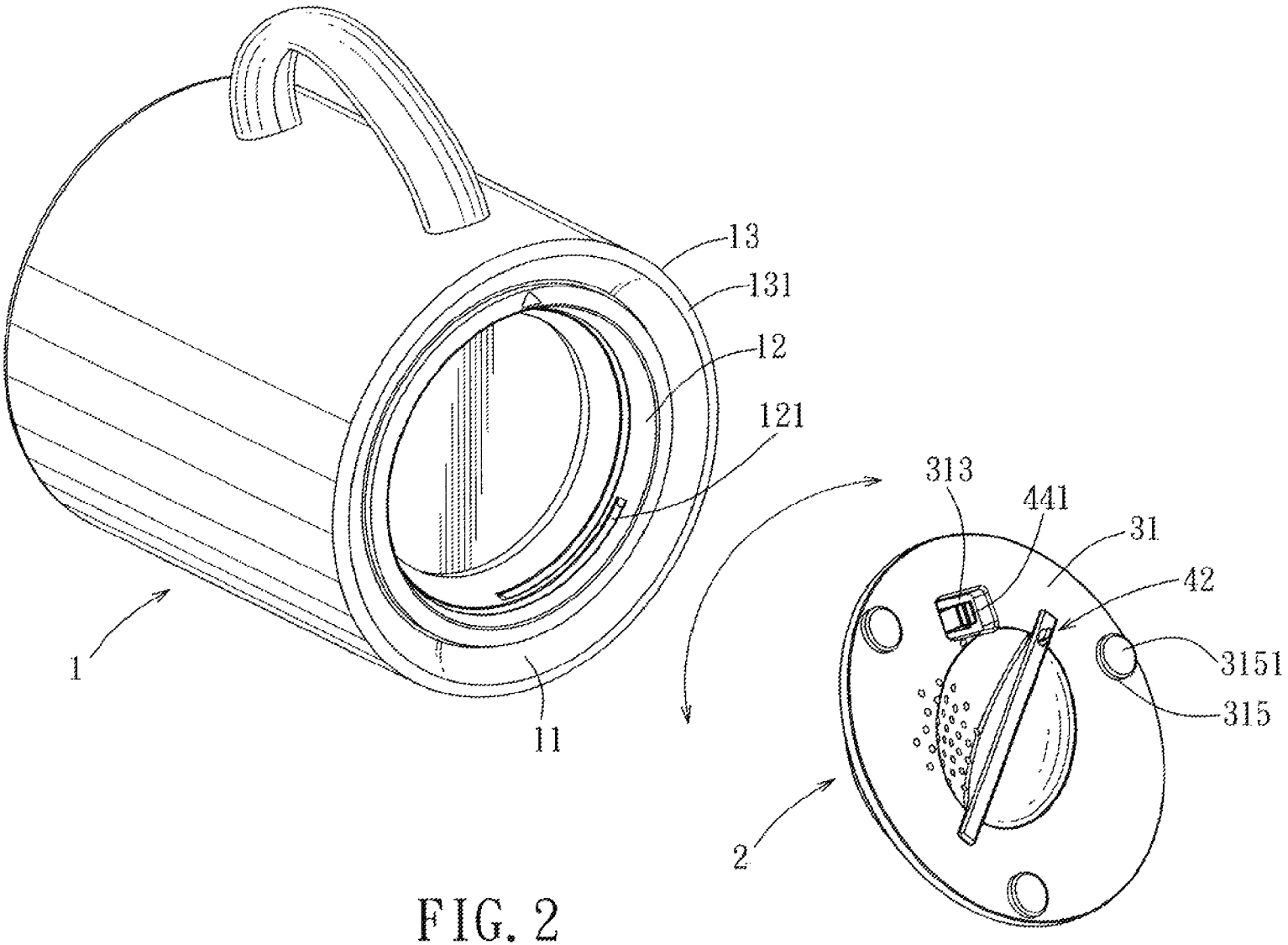
FIG. 2 is an exploded perspective view of the preferred embodiment.
Figure 3:
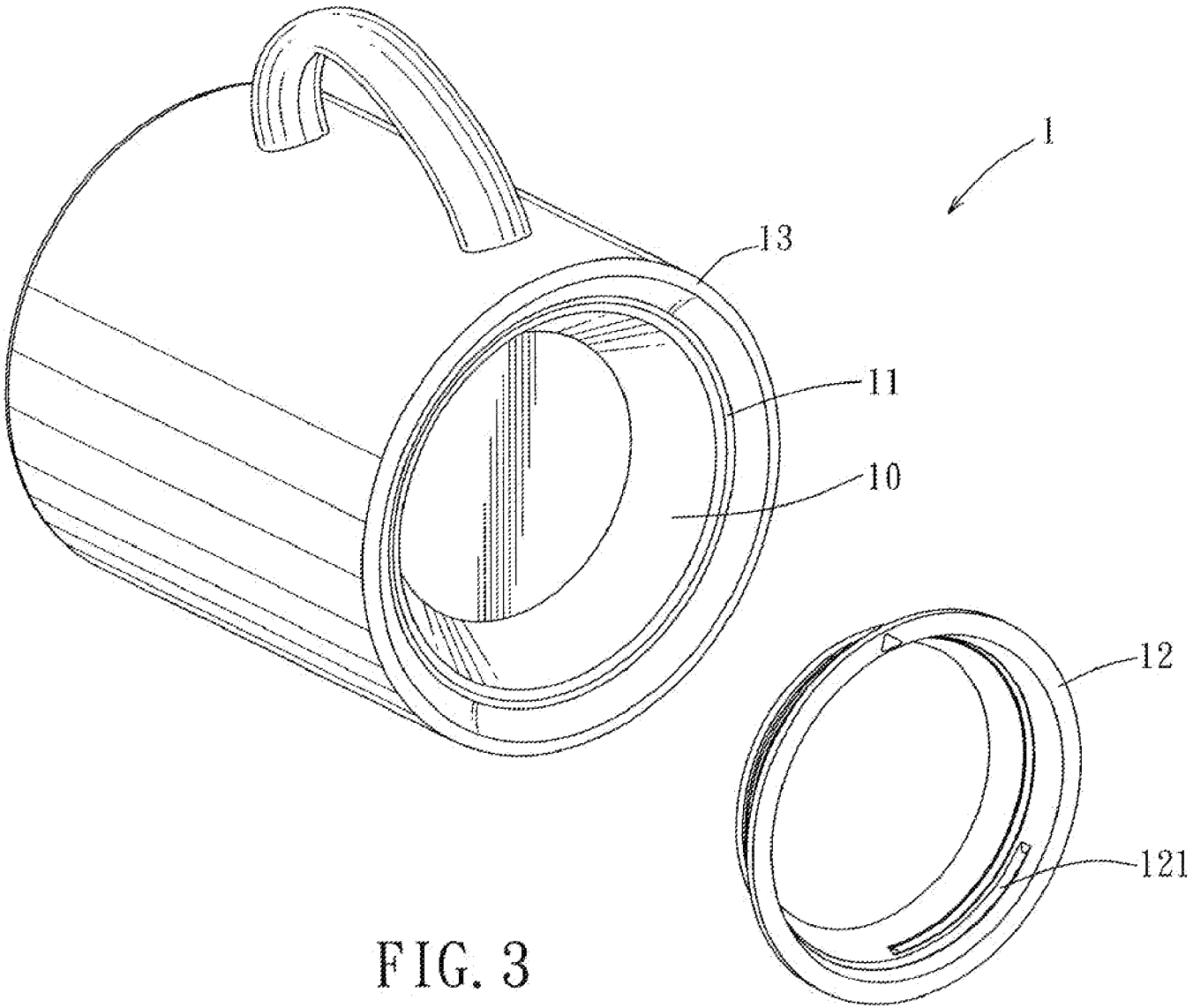
FIG. 3 is an exploded perspective view of a cup body of the preferred embodiment.
Figure 4:
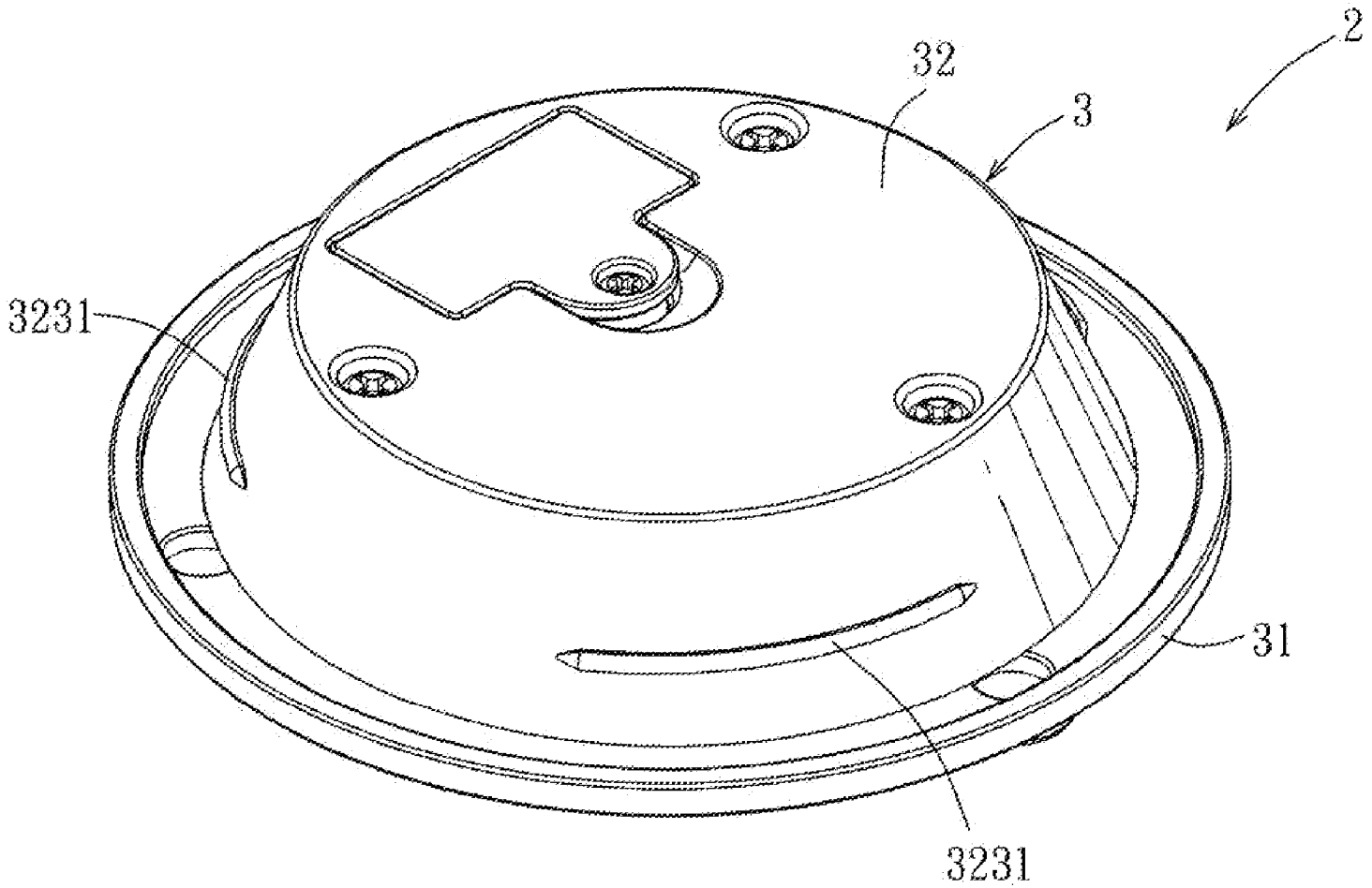
FIG. 4 is an assembled, top perspective view of an electronic module of the preferred embodiment.
Figure 5:
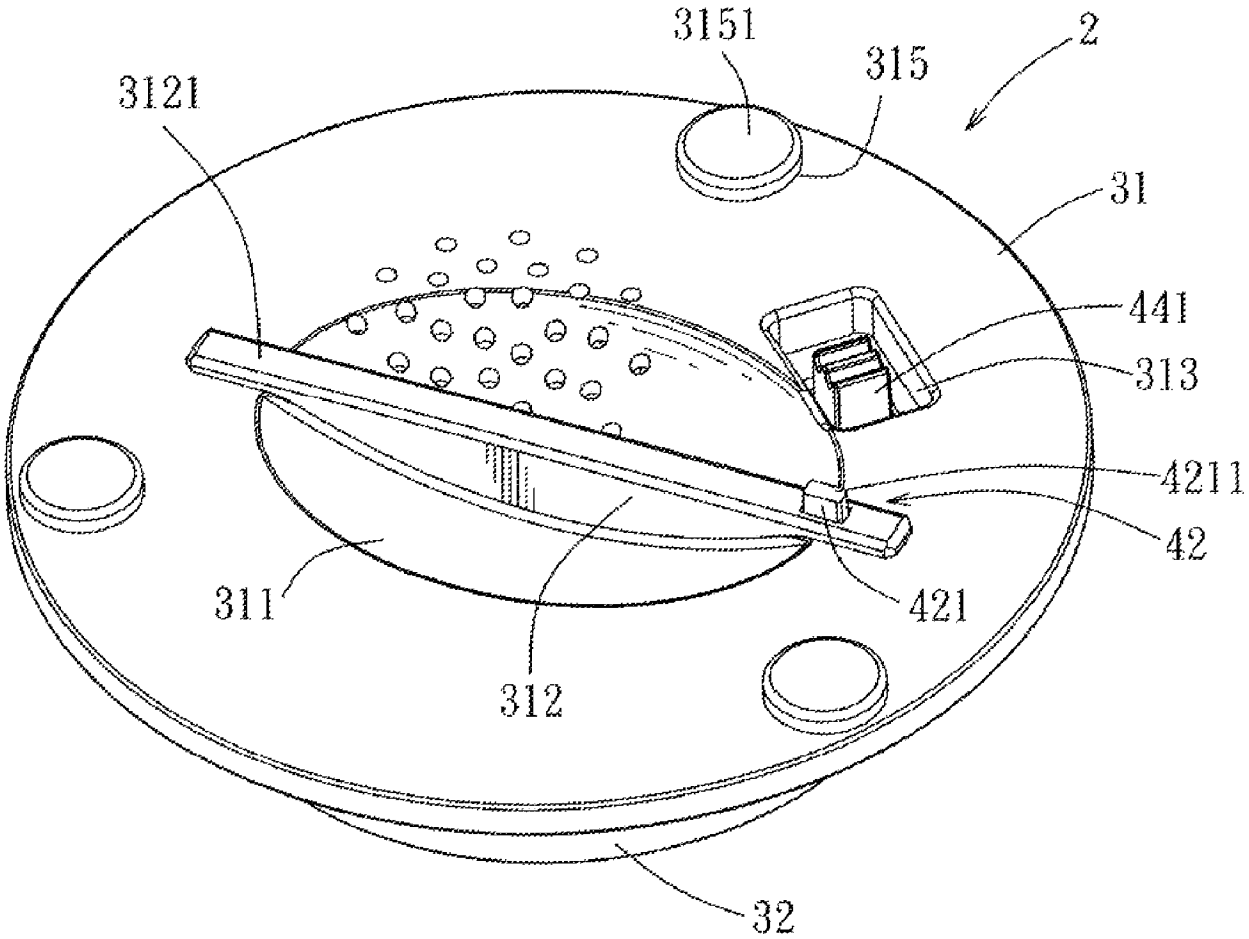
FIG. 5 is an assembled, bottom perspective view of the electronic module of the preferred embodiment.
Figure 6:
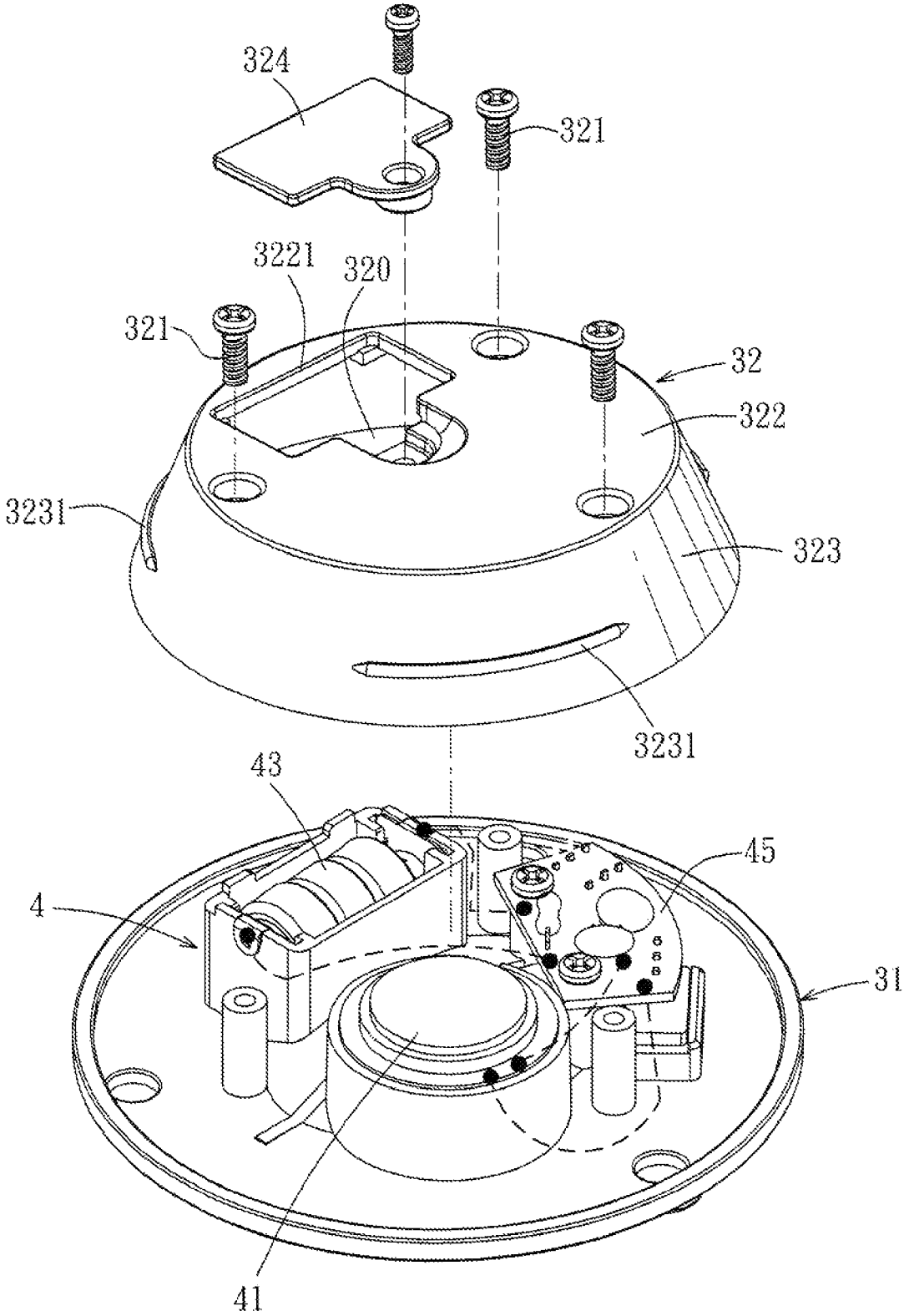
FIG. 6 is an exploded perspective view of the electronic module of the preferred embodiment.
Figure 7:
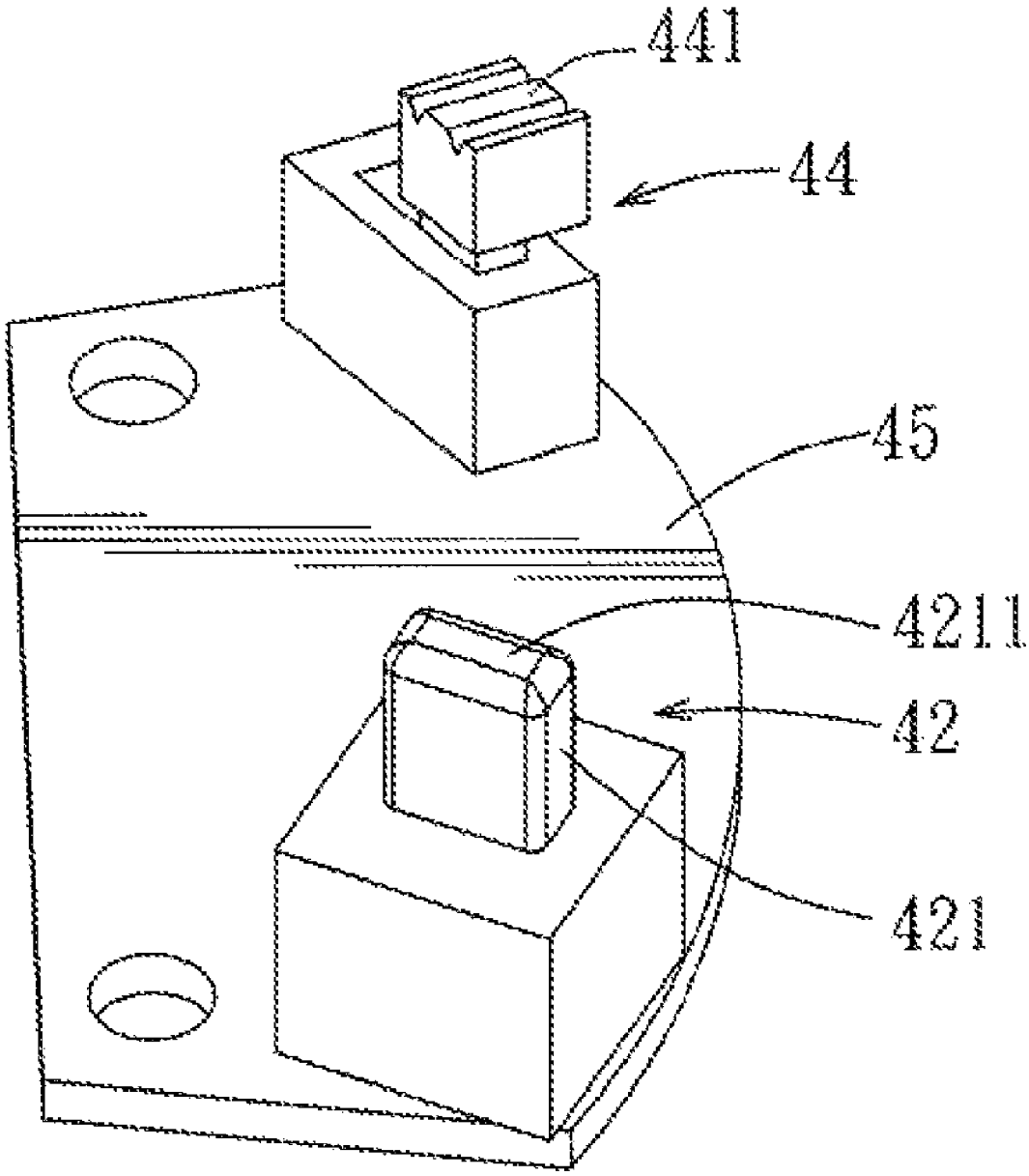
FIG. 7 is a perspective view of a circuit board and first and second switches of the preferred embodiment.

Referring to FIGS. 1 to 7, the preferred embodiment of a cup assembly according to the present invention is shown to include a cup body 1 and an electronic device 2 embedded in a bottom of the cup body 1. The electronic device 2 includes a module support 3 and a signal producing module 4.

The cup body 1 has a bottom recess 10 that is defined by a recess-defining wall and that has an open end 11. The recess-defining wall of the bottom recess 10 is provided with a threaded structure 12. The module support 3 has a base part 31 that covers the open end 11 of the bottom recess 10, and a threaded confining part 32 that is connected to the base part 31, that is received in the bottom recess 10, that defines an accommodating space 320 for accommodating the signal producing module 4, and that engages threadedly with the threaded structure 12 so as to permit the module support 3 to be detachably secured to and embedded in the cup body 1. In the preferred embodiment, the base part 3 is nearly entirely received in the bottom recess 10. Alternatively, in other embodiments, the base part 31 is fully received in the bottom recess 10.

The signal producing module 4 is mounted on the base part 31, and includes a signal producing member 91 that is adapted to generate a signal upon actuation, and a first switch 42 that is coupled to the signal producing member 41 and that is operable to enable and disable the signal producing member 41.

In this embodiment, the cup body 1 is made from a rigid material, such as a ceramic material, glass, or metal, while the threaded structure 12 is made from a plastic material different from the rigid material, has a truncated conical shape, and is attached adhesively to the recess-defining wall of the bottom recess 10. The threaded structure 12 is formed with female threads 121.

In this embodiment, the threaded confining part 32 of the module support 3 is made from a plastic material and has a cap-like shape. Moreover, the threaded confining part 32 is detachably fastened to the base part 31 through fasteners 321, and has a top wall portion 322 that is opposite to the base part 31, and a surrounding wall portion 323 that extends from a peripheral edge of the top wall portion 322 toward the base part 31. The top wall portion 322 of the threaded confining part 32 is formed with an access opening 3221 for access into the accommodating space 320, and is provided with a lid 324 detachably connected to the top wall portion 322 for covering and uncovering the access opening 3221. The surrounding wall portion 323 of the threaded confining part 32 is formed with male threads 3231 threadedly engaging with the female threads 121 of the threaded structure 12 of the cup body 1.

Figure 8:
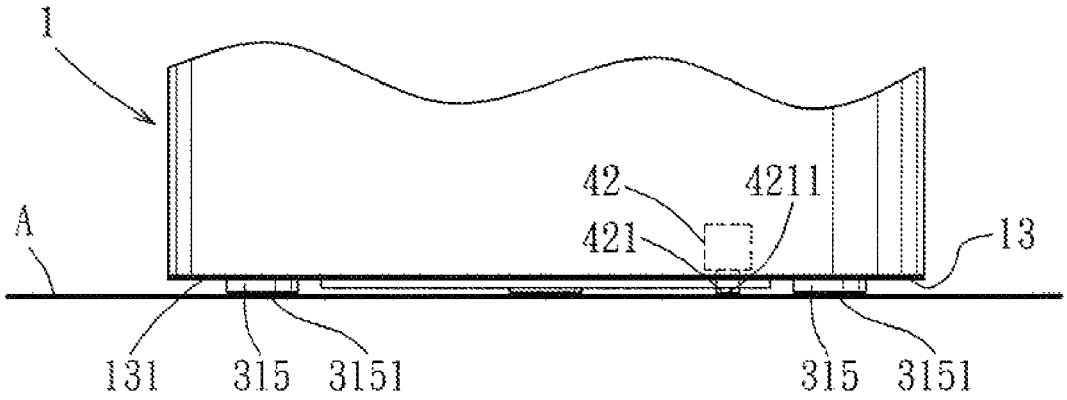
FIG. 8 is a schematic view to illustrate a pressed state of the first switch of the preferred embodiment.
Figure 9:
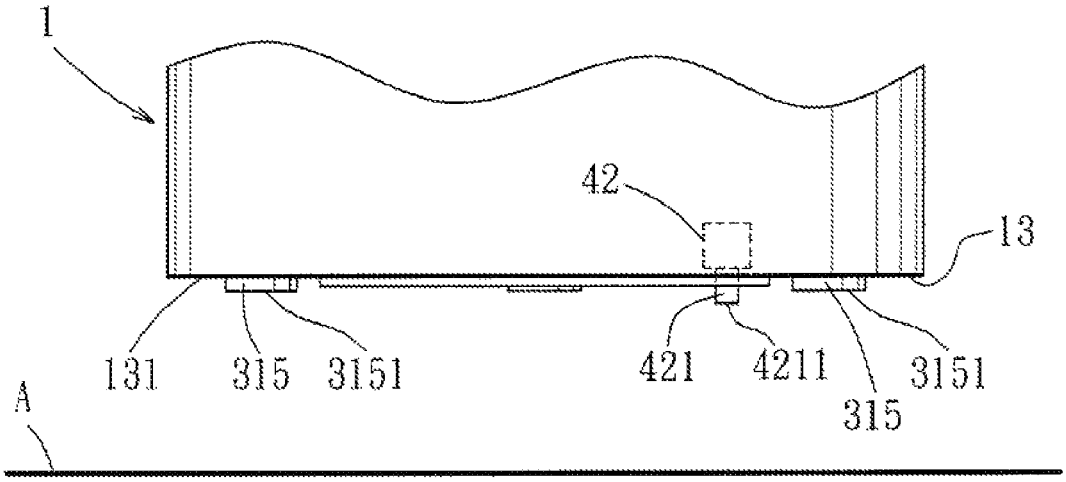
FIG. 9 is a schematic view to illustrate a non-pressed state of the first switch of the preferred embodiment.

The cup body 1 further has an annular bottom end 13 surrounding the open end 11 of the bottom recess 10 and having an end face 131. The base part 31 has an outer surface that is formed with a plurality of pads 315 protruding outwardly therefrom and spaced apart from each other. The pads 315 have end faces 3151, respectively, that are substantially coplanar with each other and that are disposed below the end face 131 of the (annular) bottom end 13 of the cup body 1 so that when the cup assembly is placed on a table (not shown), the pads 315 can contact the table. The first switch 42 includes a pressable button 421 extending outwardly through the base part 31 of the module support 3 and having a free end with an end face 4211. When the cup body 1 is placed on a table surface (A), the pressable button 421 is pressed against the table surface (A) by the weight of the cup body 1 such that the end face 4211 of the free end of the pressable button 421 is flush with the end faces 3151 of the pads 315 (see FIG. 8), thereby disabling the signal producing member 41, and when the cup body 1 is raised from the table surface (A), the pressable button 421 is released such that the end face 4211 of the free end of the pressable button 421 is disposed below the end faces 3151 of the pads 315 (see FIG. 9), thereby enabling the signal producing member 41.

In some embodiments, the opposite operation may occur with the raising and lowering of the cup body 1 from the table surface (A). That is, in some embodiments, when the cup body 1 is placed on the table surface (A), such that the pressable button 421 is pressed, the signal producing member 41 is activated, and when the cup body 1 is raised from the table surface (A), such that the pressable button 421 is released, the signal producing member 41 is deactivated.

The outer surface of the base part 31 has an indented portion 311, and is provided with a handle bar 312 protruding outwardly from the indented portion 311 of the outer surface of the base part 31 for gripping by the fingers for facilitating securing and loosening of the module support 3 to and from the cup body 1. The handle bar 312 has a bottom end face 3121 substantially flush with the end faces 3151 of the pads 315. The pressable button 421 of the first switch 42 extends through the bottom end face 3121 of the handle bar 312.

The signal producing module 4 further includes a power source 43 and a second switch 44. The second switch 44 is coupled to the power source 43 and the first switch 42 for controlling electrical connection between the first switch 42 and the power source 43. The power source 43 includes a plurality of serial connected batteries mounted in a battery compartment received in the accommodating space 320 coupled to the circuit board 45. In some embodiments, the power source 43 is mounted on the circuit board 45. The base part 31 is formed with a slot 313. The second switch has an operating knob 441 extending outwardly through the slot 313 for operation of turning on or off the second switch 44. The first and second switches 42, 44 are mounted on a circuit board 45. A memory chip (not shown) and an IC controller (not shown) are also mounted on the circuit board 45 and are coupled to the first and second switches 42, 44, the signal producing member 41, and the power source 43. In this embodiment, the signal producing member 41 is a speaker. The memory chip stores data, such as songs, greetings, audio messages, and the like. The IC controller controls the data stored in the memory chip to be reproduced by the signal producing member 41.

In operation, when the cup assembly is raised from the table surface (A) and when the second switch 44 is disposed at an on-position (not shown), the first switch 42 is turned on, thereby actuating the signal producing member 41 to reproduce the data stored in the memory chip, and when the cup assembly is placed on the table surface (A), the first switch 42 is turned off, thereby deactivating the signal producing member 41. Hence, while the cup assembly of this invention looks like a normal cup, the ability of reproducing data, such as sounds and songs, from the cup body 1 can provide a surprise effect on the user.

When the second switch 44 is disposed at an off-position (not shown), the first switch 42 has no control over the signal producing member 41 and the signal producing member 41 cannot be actuated by raising the cup assembly from (or lowering the cup assembly onto) the table surface (A).

By forming the bottom recess 10 in the cup body 1 and with the inclusion of the threaded structure 12 in the cup body 1 and the threaded confining part 32 in the module support 3, the cup assembly of this invention appears as if it is simply a normal cup, such that a surprise effect can be achieved when the cup assembly is lifted from the table surface (A).

With the invention thus explained, it is apparent that various modifications and variations can be made without departing from the spirit of the present invention.

What is claimed is:

1. A cup assembly with circuit actuating capability, comprising:

a cup body having a bottom recess that is defined by a recess-defining wall and that has an open end, said recess-defining wall being provided with a threaded structure;

a module support having a base part that covers said open end of said bottom recess, and a threaded confining part that is connected to said base part, that is received in said bottom recess, that defines an accommodating space, and that engages threadedly with said threaded structure so as to permit said module support to be detachably secured to and embedded in said cup body; and a signal producing module mounted on said base part, received in said accommodating space, and including a signal producing member that is adapted to generate a signal upon actuation, and a first switch situated at the bottom of said base part that is coupled to said signal producing member and that is operable to enable and disable said signal producing member;

wherein said base part has an outer surface formed with a plurality of pads protruding outwardly therefrom, said pads having end faces, respectively, that are substantially coplanar, said first switch including a pressable button extending outwardly through said base part of said module support and having a free end with an end face, said end face of said free end of said pressable button being flush with said end faces of said pads when said pressable button is pressed, thereby disabling said signal producing member, and being disposed below said end faces of said pads when said pressable button is released from being pressed, thereby enabling said signal producing member.

2. The cup assembly of claim 1, wherein said cup body is made from a rigid material, said threaded structure being made from a plastic material different from said rigid material and being attached adhesively to said recess-defining wall of said bottom recess.

3. The cup assembly of claim 2, wherein said threaded confining part of said module support is made from a plastic material and has a cap-like shape.

4. The cup assembly of claim 3, wherein said threaded confining part is detachably fastened to said base part.

5. The cup assembly of claim 4, wherein said threaded confining part has a top wall portion that is opposite to said base part, and a surrounding wall portion that extends from a peripheral edge of said top wall portion toward said base part, said top wall portion being formed with an access opening for access into said accommodating space, and being provided with a lid detachably connected to said top wall portion for covering and uncovering said access opening.

6. The cup assembly of claim 1, wherein said outer surface of said base part has an indented portion, said base part being provided with a handle bar protruding outwardly from said indented portion of said outer surface.

7. The cup assembly of claim 6, wherein said handle bar has a bottom end face, said pressable button extending through said bottom end face of said handle bar.

8. The cup assembly of claim 1, wherein said signal producing module further includes a power source and a second switch coupled to said power source and said first switch for controlling electrical connection between said first switch and said power source.

9. The cup assembly of claim 8, wherein said base part is formed with a slot, said second switch having an operating knob extending outwardly through said slot.

10. The cup assembly of claim 1, wherein said signal producing member is a speaker.

* * * * *